US005163688A

United States Patent [19]

Simms

[11] Patent Number: 5,163,688

[45] Date of Patent: * Nov. 17, 1992

[54] METHOD OF PLAYING A CARD GAME SIMULATING WRESTLING

[76] Inventor: Cosmian E. Simms, 5510 Fernpark Ave., Baltimore, Md. 21207

[ * ] Notice: The portion of the term of this patent subsequent to Oct. 15, 2008 has been disclaimed.

[21] Appl. No.: 760,060

[22] Filed: Sep. 13, 1991

Related U.S. Application Data

[63] Continuation of Ser. No. 584,084, Sep. 18, 1990, Pat. No. 5,056,794.

[51] Int. Cl.[5] ..... A63F 1/00

[52] U.S. Cl. ..... 273/298; 273/308

[58] Field of Search ..... 273/298, 304–306, 273/308, DIG. 28, 856, 272

[56] References Cited

U.S. PATENT DOCUMENTS

| | | | |
|---|---|---|---|
| 1,322,954 | 11/1919 | Rosenfeld | 273/298 |
| 1,640,261 | 8/1927 | Whaley et al. | 273/298 |
| 4,793,617 | 12/1988 | Sanon | 273/298 |

FOREIGN PATENT DOCUMENTS

| | | | |
|---|---|---|---|
| 2164262 | 3/1986 | United Kingdom | 273/298 |

*Primary Examiner*—Benjamin H. Layno
*Attorney, Agent, or Firm*—Leonard Bloom

[57] ABSTRACT

A competitive wrestling game that simulates a competitive wrestling match. The game includes a plurality of images which represent various wrestling action maneuvers, submission maneuvers, escape maneuvers, reverse maneuvers and substitute maneuvers. The method of playing the game comprises the competitors drawing images and the competitor determining when to display a predetermined sequence of images. The opponent must then display a counter maneuver and if the counter maneuver is unavailable, the competitor is assigned a designator. Play is sequential between the players until a sequence of designators is accumulated to determine the loser. A tag team wrestling match is also simulated in which there is competition between two teams of two players each. The partners of any one team may tag one another under specified conditions to compete against the identified member of the opposing team. The tag team match follows substantially the same procedure as the game between two players. However, the team partners may compare images and determine a strategy of play.

10 Claims, 18 Drawing Sheets

METHOD OF PLAYING A CARD GAME SIMULATING WRESTLING

This application is a continuation of U.S. patent application Ser. No. 584,084, filed Sept. 18, 1990 now U.S. Pat. No. 5,056,794.

FIELD OF THE INVENTION

The present invention relates to a competitive game to simulate a sporting event and more particularly to a game to simulate the sport of wrestling.

BACKGROUND OF THE INVENTION

There have been many games devised which simulate actual sporting events. Some of these games have been in the form of competitive card games and video games. The games of which I am aware are those described in U.S. Letters Pat. No. 1,322,954 issued to Rosenfeld; U.S. Pat. No. 1,404,599 issued to Glenny; U.S. Pat. No. 1,640,261 issued to Whaley et al and U.S. Pat. No. 4,861,031 issued to Simms. The only one of these games relating to wrestling is that of Simms. However, there are improvements to the game of Simms which increase interest, competition and entertainment.

SUMMARY OF THE INVENTION

Accordingly, it is a primary object of the present invention to provide a competitive game which simulates the actual sport of wrestling.

It is another object of the present invention to provide such a competitive game that is a competitive card game.

It is a further object of the present invention to provide such a competitive game that is a competitive video game.

It is yet another object of the present invention to provide a competitive wrestling game wherein one competitor sequentially displays a predetermined sequence of wrestling maneuvers which must be countered by the other competitor, and if not countered, the other competitor is assigned a designator, such that accumulation of designators determines the competitor to be the loser.

It is still another object of the present invention to provide a competitive tag team wrestling game to be played by four competitors forming two teams of two partners each.

It is still a further object of the present invention to provide a competitive team game in which the partners on each team compare images to develop a strategy of play.

In accordance with the broad teachings of the present invention, there is herein illustrated and described a method of playing a competitive game for two or more competitors that simulates a competitive wrestling match. The game has a plurality of images including a first portion of images representing wrestling "action" maneuvers, a second portion of the images representing wrestling "submission" maneuvers, a third portion of the images representing wrestling maneuvers to "escape", said images countering maneuvers of portions first through second, a fourth portion representing maneuvers to "reverse", said images countering maneuvers of portions first through third and a fifth portion representing "substitute" maneuvers to include any selected maneuver represented in portions first through fourth. The game further has a plurality of designators.

The method comprises a sequence of steps. The order in which the competitors are to take turns is determined, whereby a first competitor and a second competitor are defined. Each competitor randomly draws, in turn, a first plurality of at least three images such that each competitor has an odd number of images. Each competitor further has an equal number of images. The first competitor draws an additional image, whereby the first competitor has a first combined plurality of images available from which to choose and display. The first competitor displays, if available, a submission image plus a predetermined sequence of action images. If such images are not available, the first competitor passes any display. The second competitor draws an additional image, whereby the second competitor has a second combined plurality of images available from which to choose and display. The second competitor displays, if available, the submission image plus the predetermined sequence of action images. If such images are not available, the second competitor passes any display. The competitor not displaying said predetermined sequence of images, displays an image which counters the submission sequence of images. When said counter image is unavailable to said competitor, said competitor discards all images in excess of the images selected by said competitor. Said competitor is assigned a designator. The competitors sequentially draw and display images. The plurality of designators are assigned consecutively to the competitor not displaying the counter image. The competitor accumulating the predetermined sequence of designators is determined to be the loser.

Alternatively, there is herein described and illustrated a method of playing a competitive game for four competitors that simulates a competitive wrestling tag team match. A first team has two partners and a second opposing team has two partners. The game has a plurality of images representing wrestling maneuvers. The method comprises a sequence of steps. Each competitor randomly draws, in turn, a plurality of images such that each competitor has an odd number of images. Each competitor has an equal number of images. The partners of each team compare images and determine a strategy of play. A member of the first team and a member of the second opposing team are identified to challenge one another. The identified members of the opposing teams draw images in alternating sequence. If desired, the identified member tags the team partner to interchange the identified member of the respective team between the partners of the respective team. A predetermined submission sequence of images is displayed by the one of the identified team members. If available, a counter image is displayed by the other of the identified opposing team members. If the counter image is unavailable, a designator is assigned to the team not displaying the counter image. The respective identified members sequentially draw and display images. A sequence of designators are assigned to the team not displaying the counter image. The team accumulating a predetermined sequence of designators is determined to be the loser.

These and other objects of the present invention will become apparent from a reading of the following specification, taken in conjunction with the enclosed drawings.

DESCRIPTION OF THE PREFERRED EMBODIMENTS

Figure 1A:
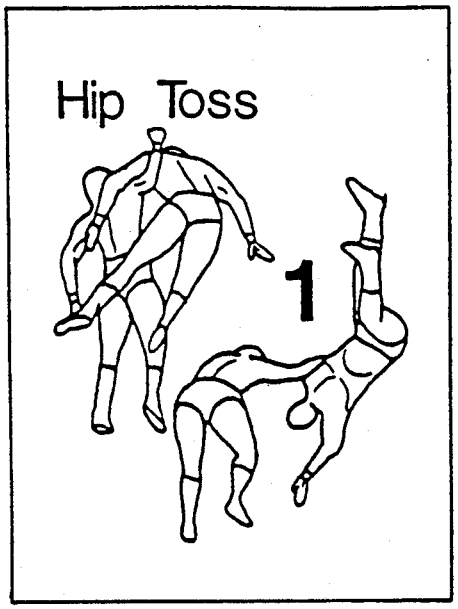
FIGS. 1A-1K illustrate the various images of wrestling "action" maneuvers displayed having the indicia "1".
Figure 1B:
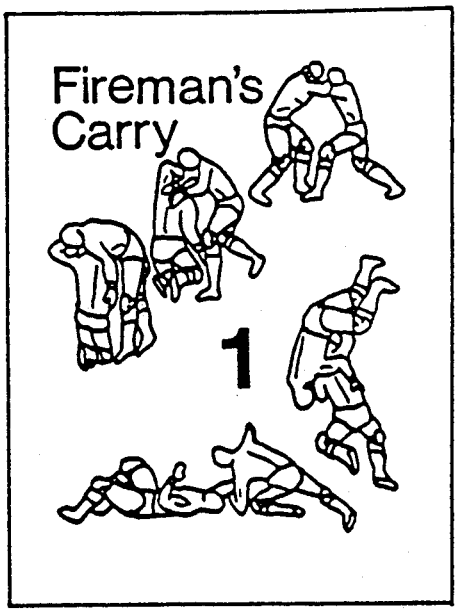
Figure 1C:
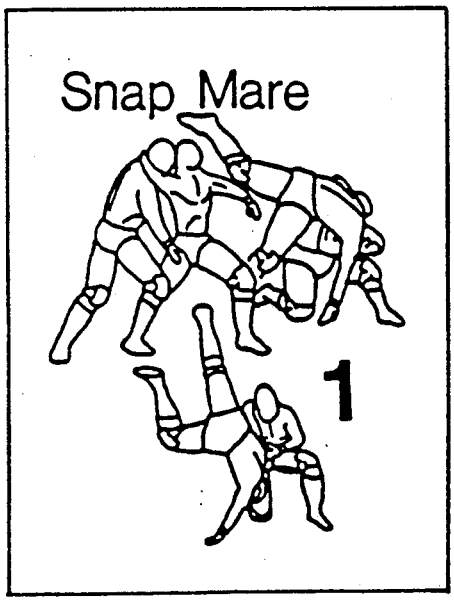
Figure 1D:
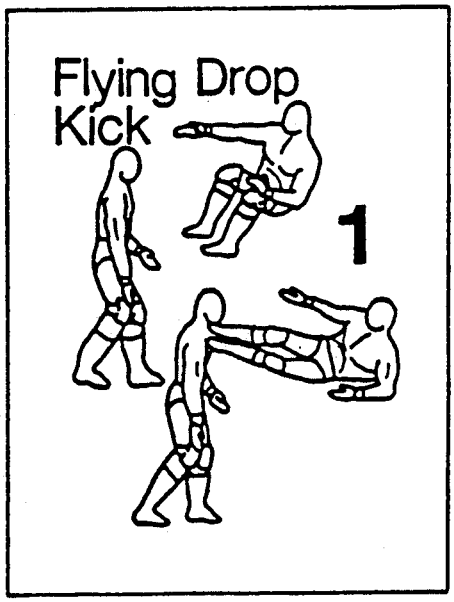
Figure 1E:
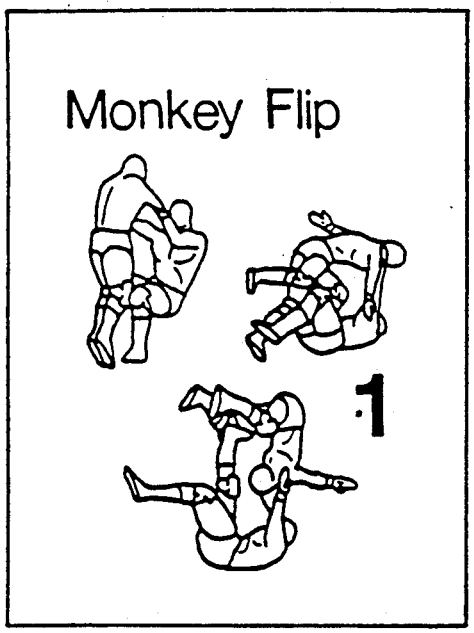
Figure 1F:
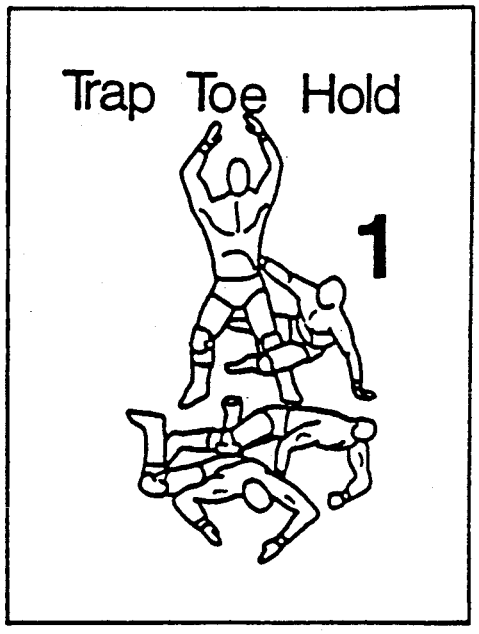
Figure 1G:
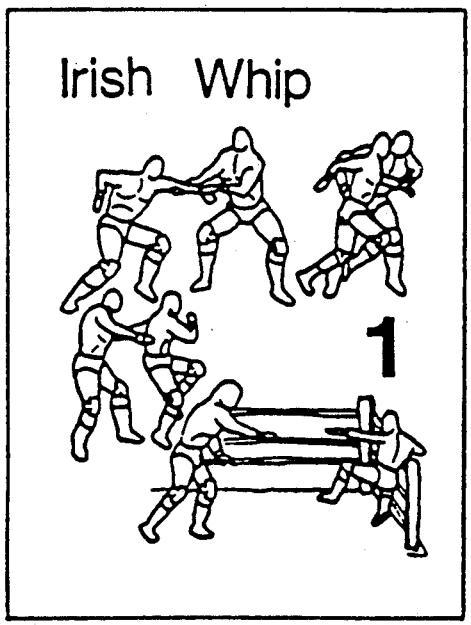
Figure 1H:
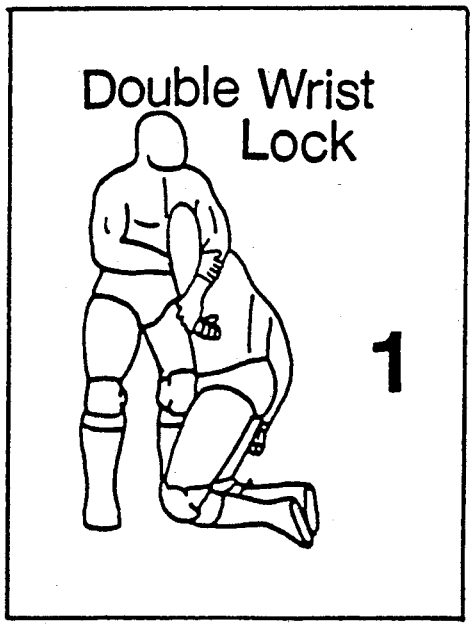
Figure 1I:
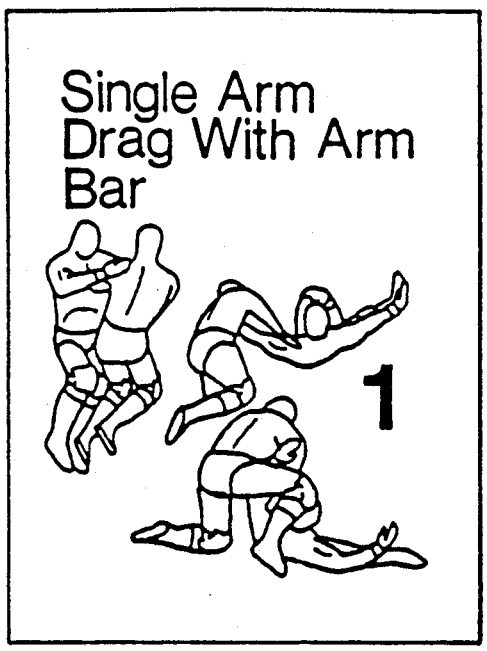
Figure 1J:
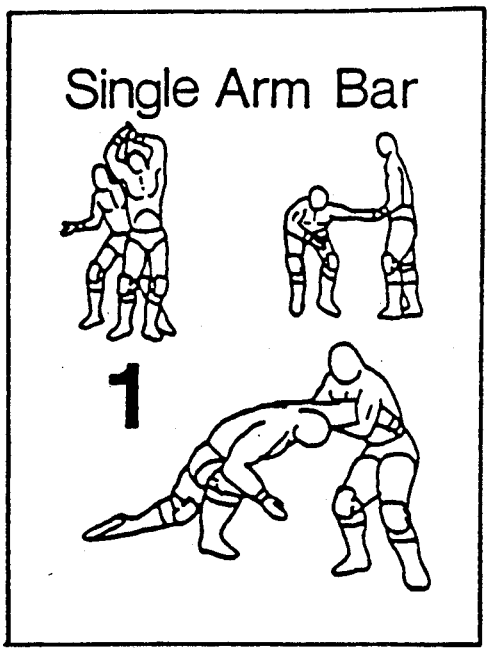
Figure 1K:
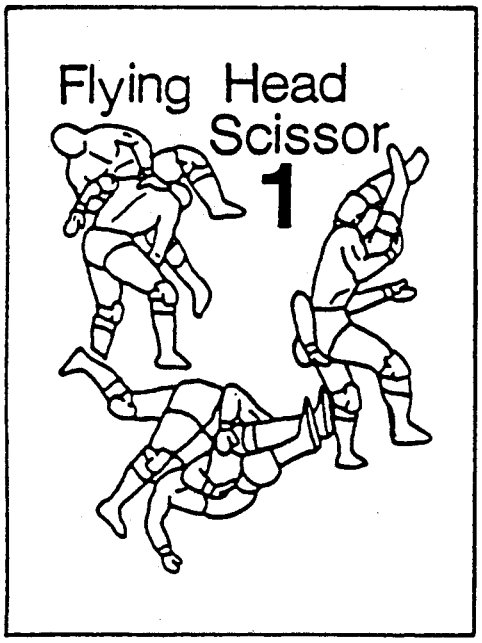
Figure 2A:
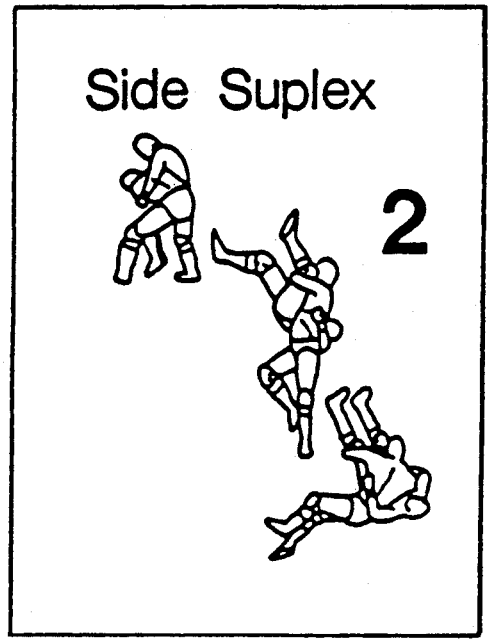
FIGS. 2A-2K illustrate the various images of wrestling "action" maneuvers displayed having the indicia "2".
Figure 2B:
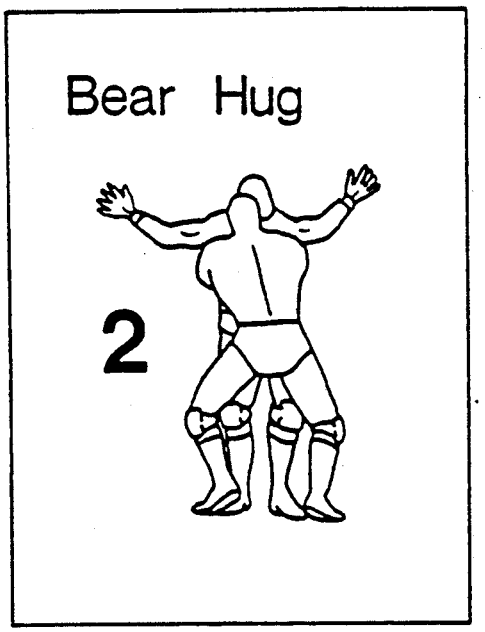
Figure 2C:
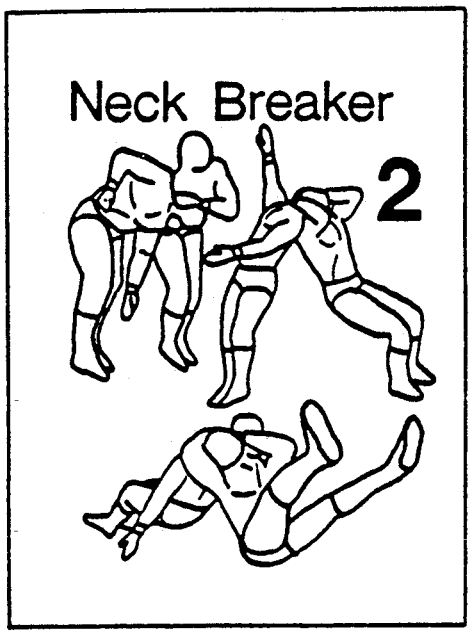
Figure 2D:
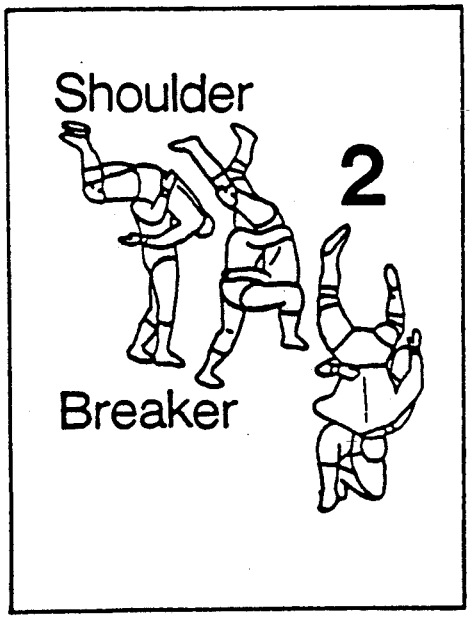
Figure 2E:
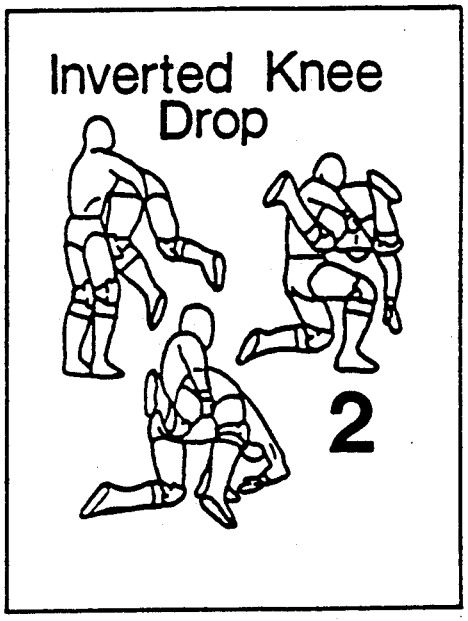
Figure 2F:
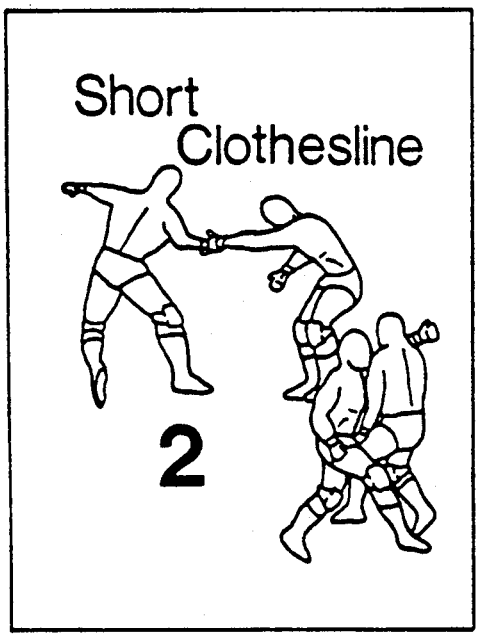
Figure 2G:
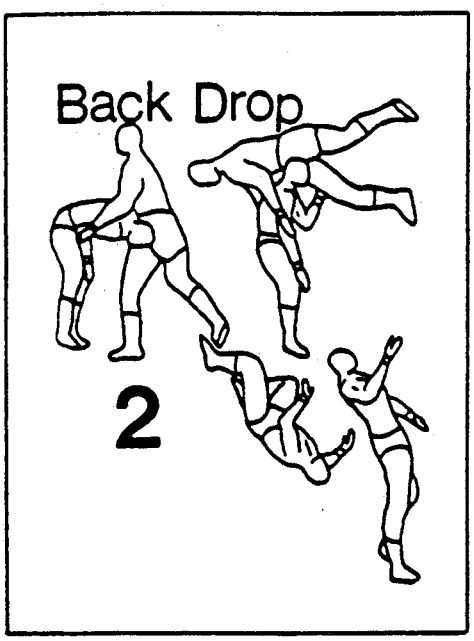
Figure 2H:
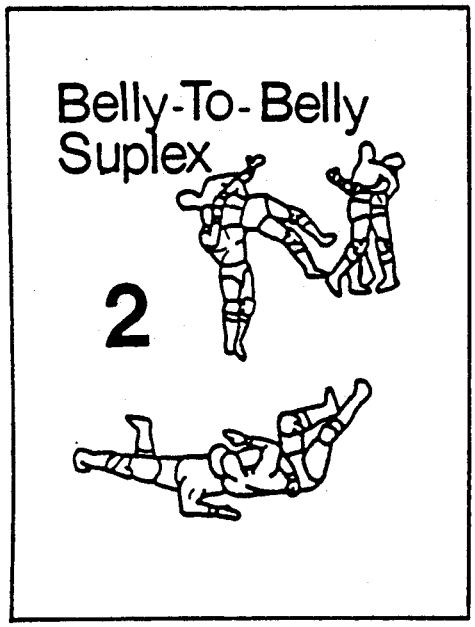
Figure 2I:
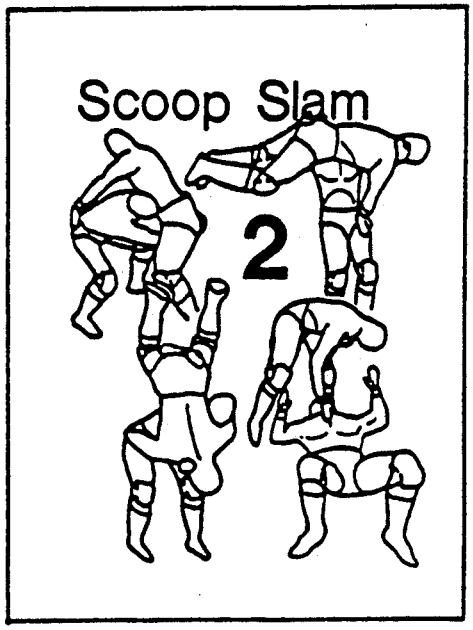
Figure 2J:
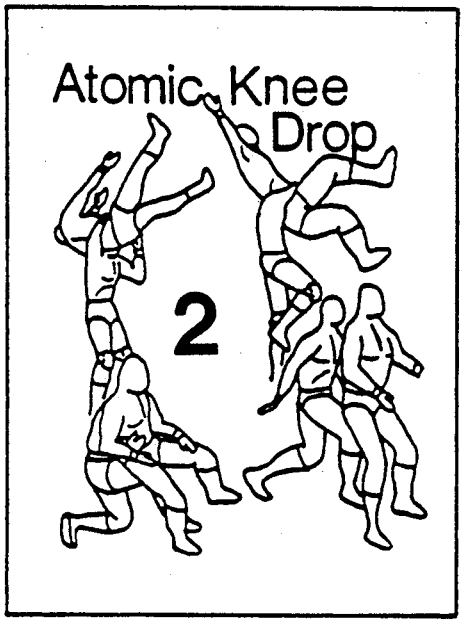
Figure 2K:
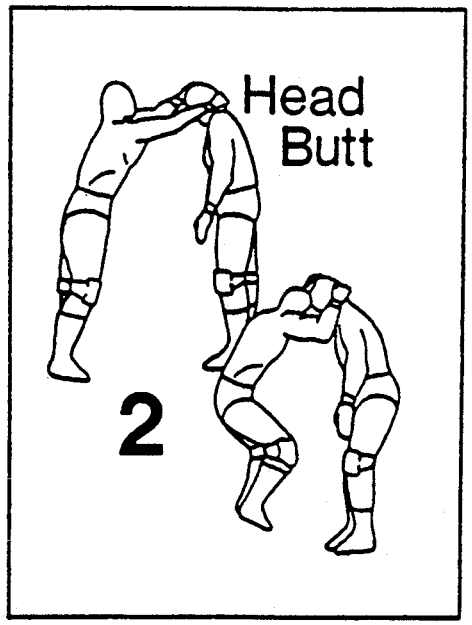
Figure 3A:
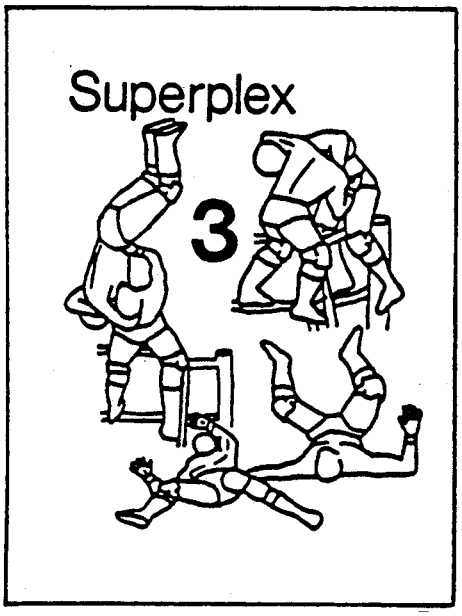
FIGS. 3A-3K illustrate the various images of wrestling "action" maneuvers displayed having the indicia "3".
Figure 3B:
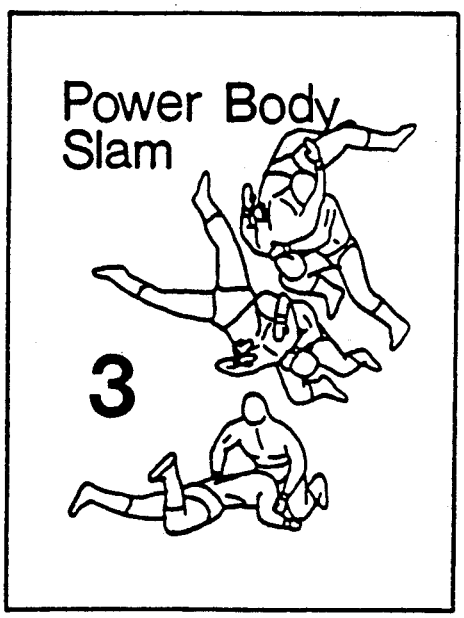
Figure 3C:
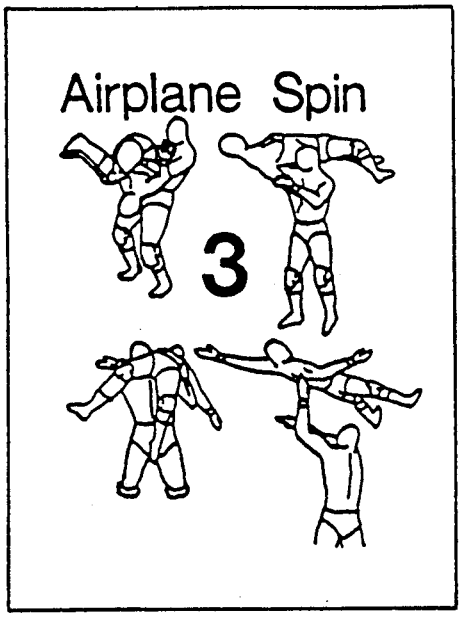
Figure 3D:
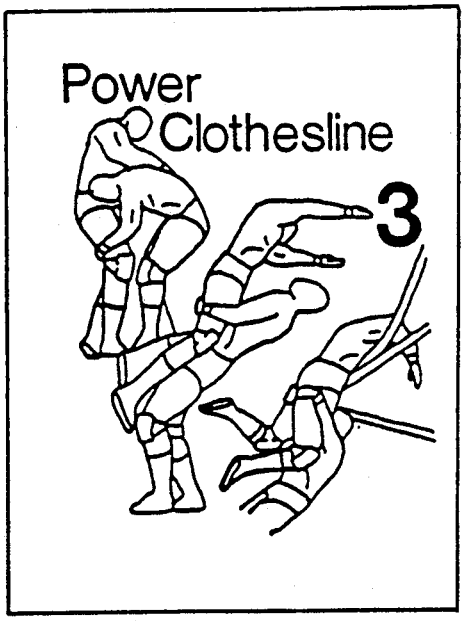
Figure 3E:
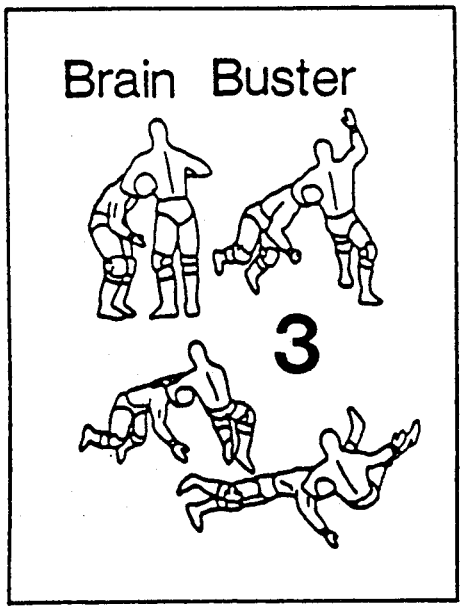
Figure 3F:
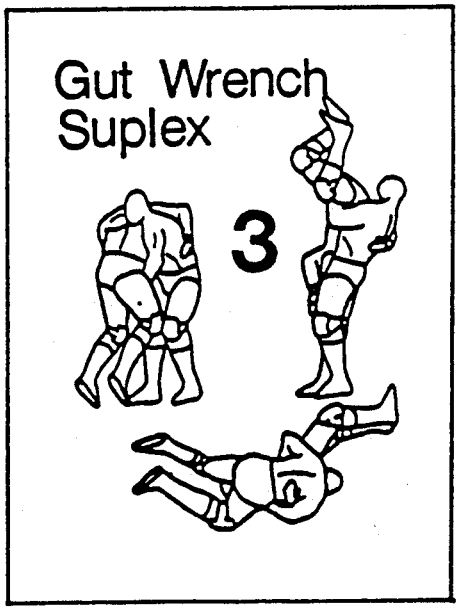
Figure 3G:
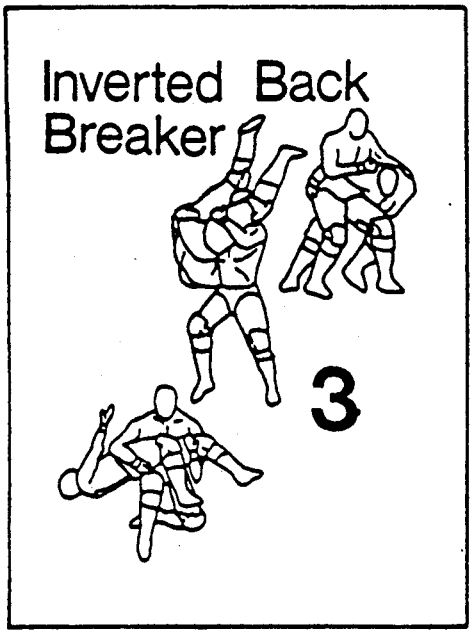
Figure 3H:
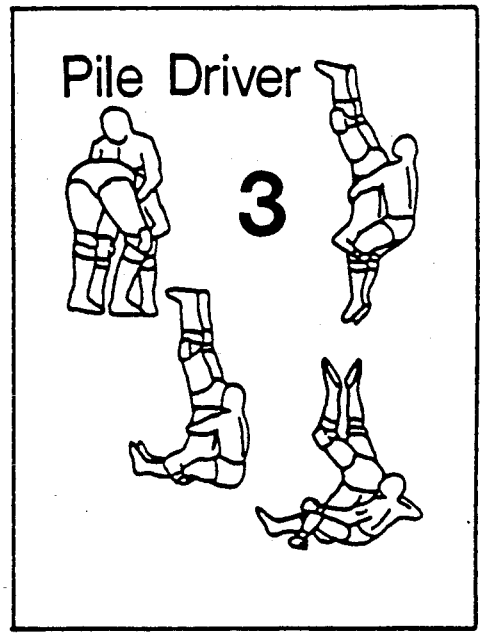
Figure 3I:
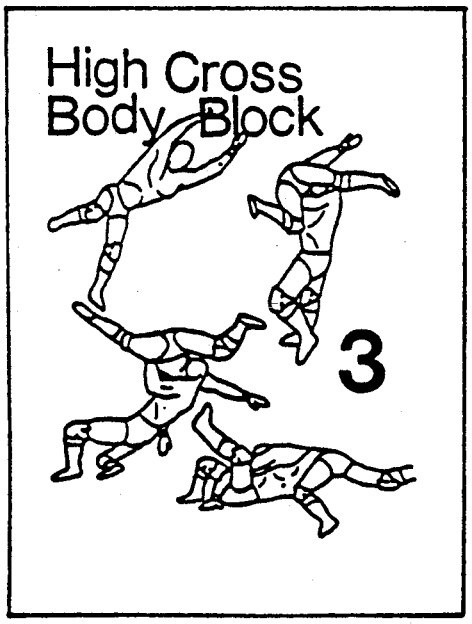
Figure 3J:
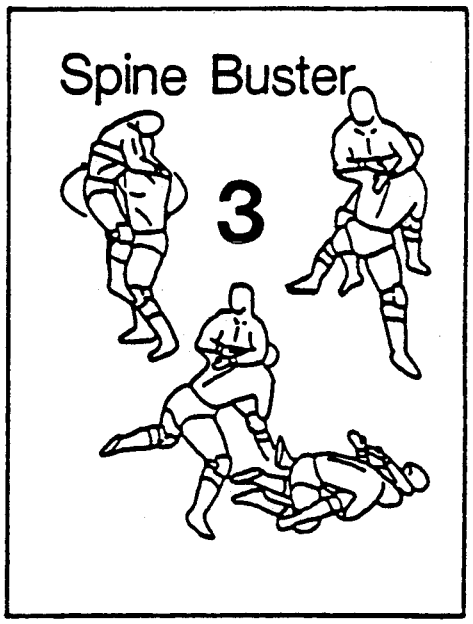
Figure 3K:
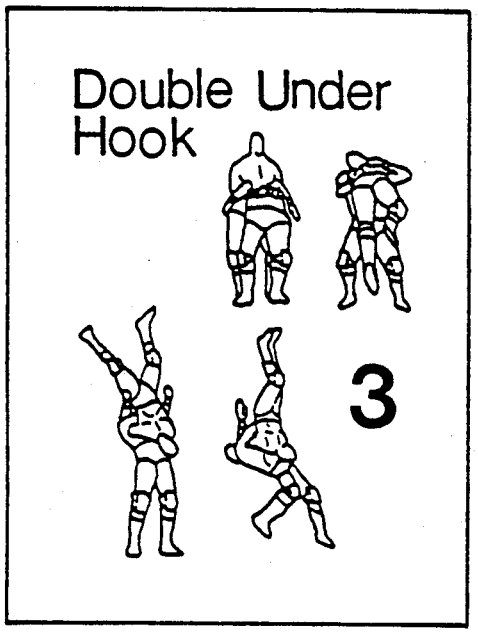
Figure 4A:
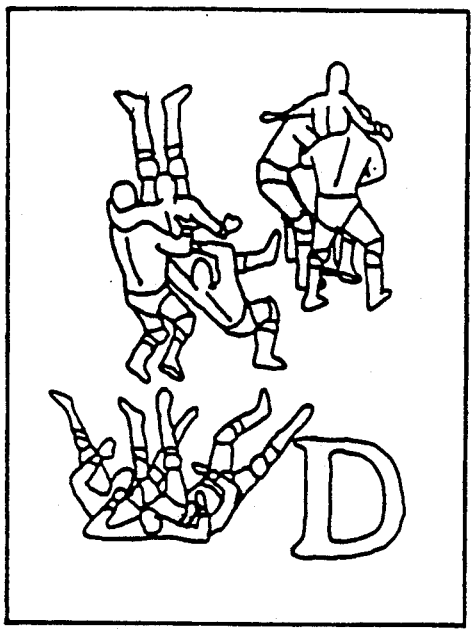
FIGS. 4A-4K illustrate the various images of wrestling "action" maneuvers displayed having the indicia "D".
Figure 4B:
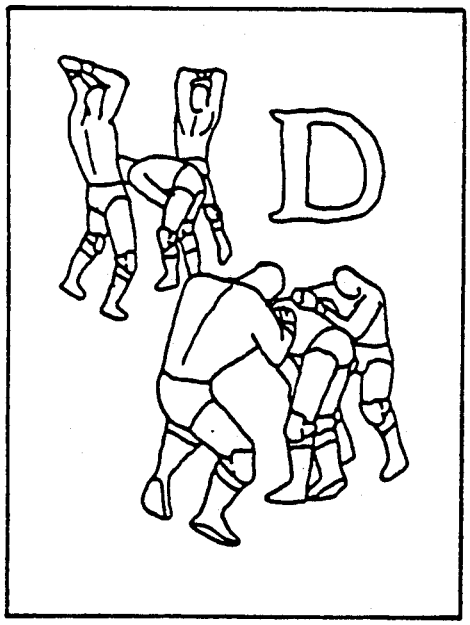
Figure 4C:
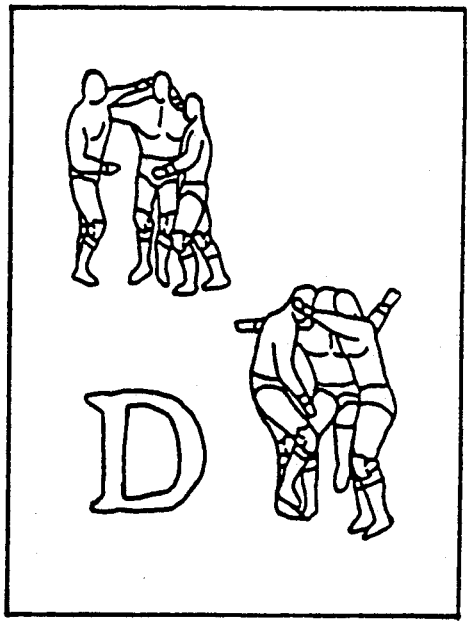
Figure 4D:
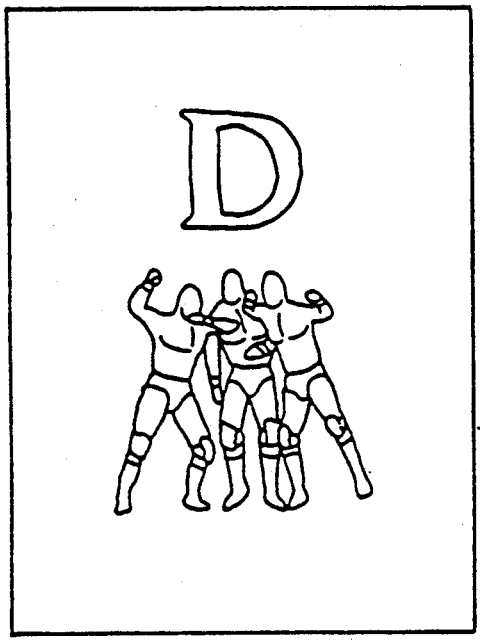
Figure 4E:
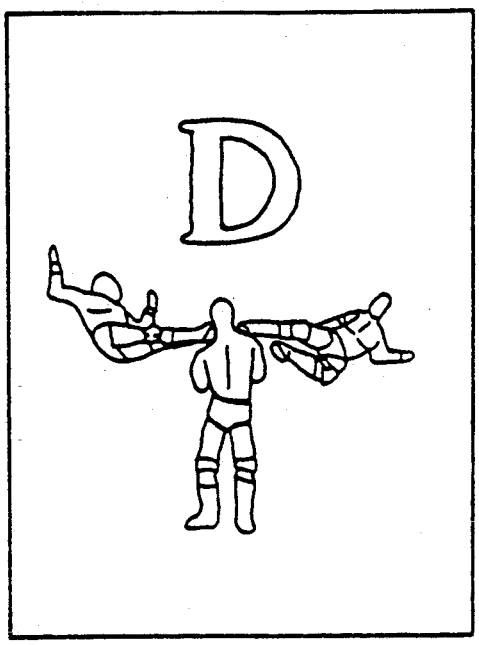
Figure 4F:
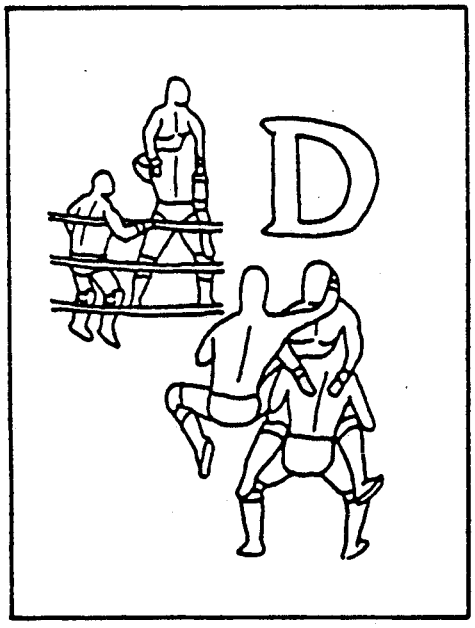
Figure 4G:
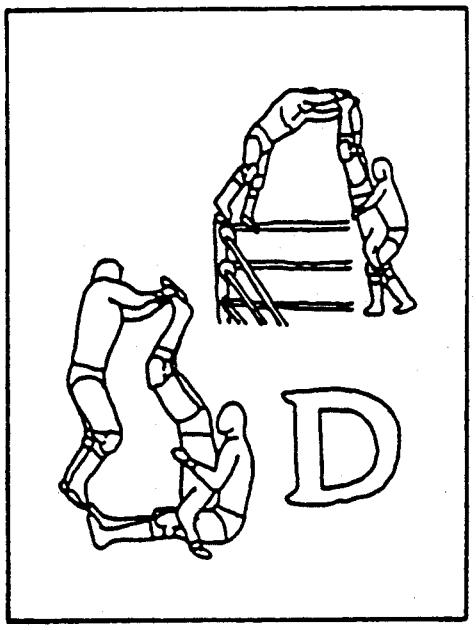
Figure 4H:
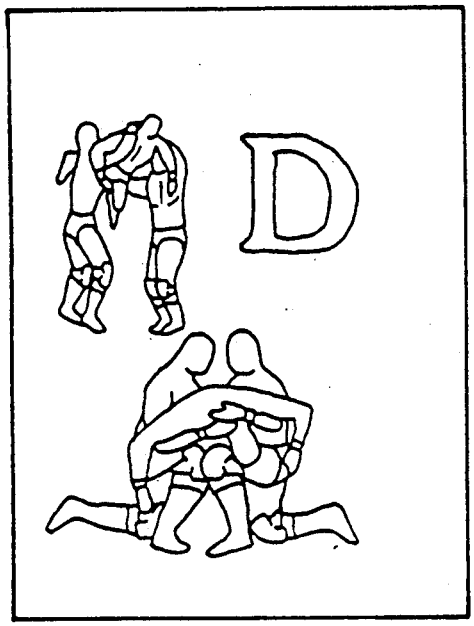
Figure 4I:
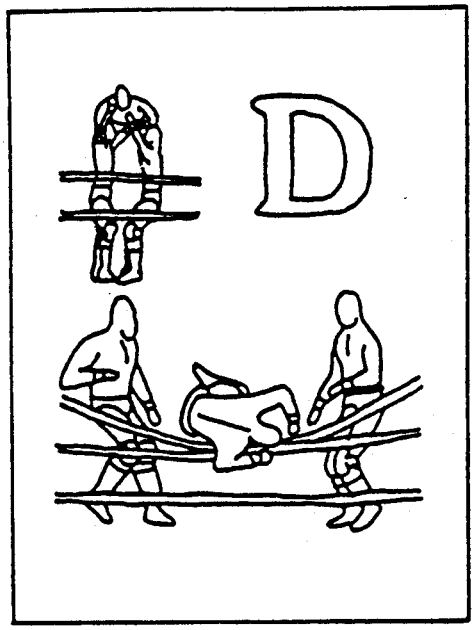
Figure 4J:
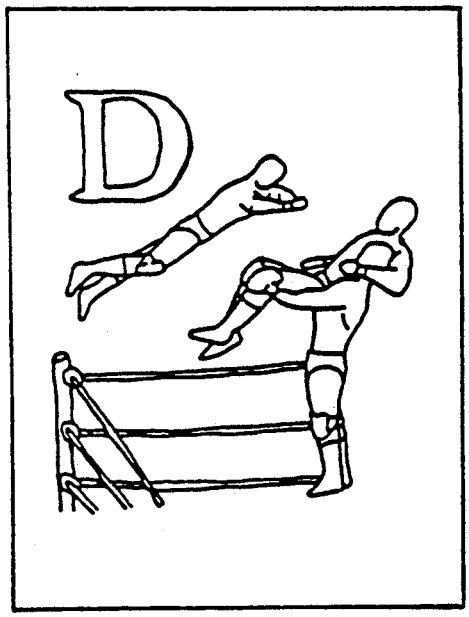
Figure 4K:
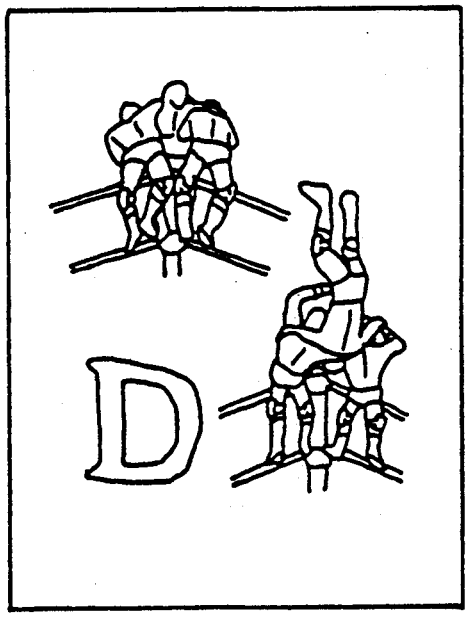
Figure 5A:
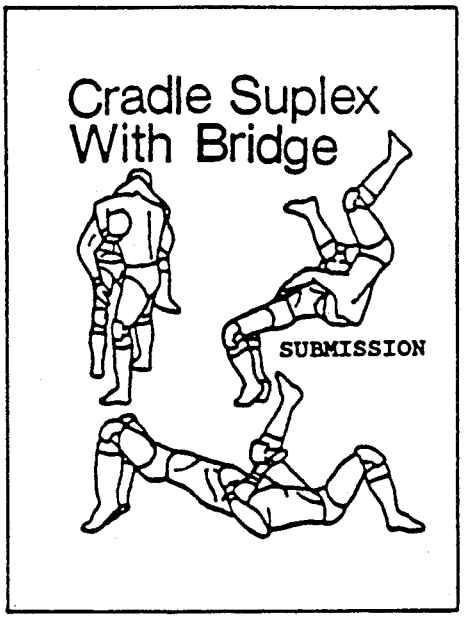
FIGS. 5A-5K illustrate the various images of wrestling "submission" maneuvers displayed.
Figure 5B:
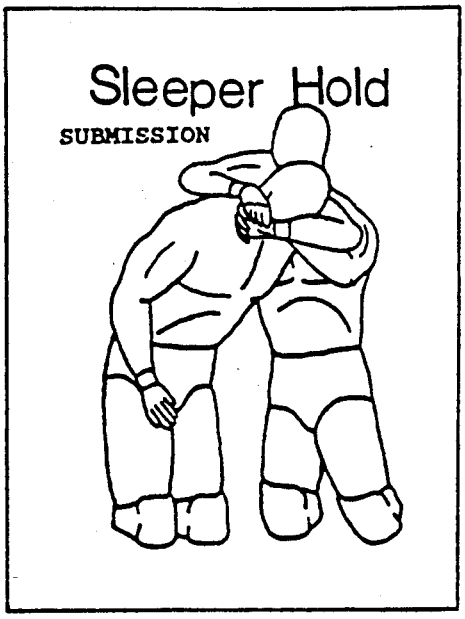
Figure 5C:
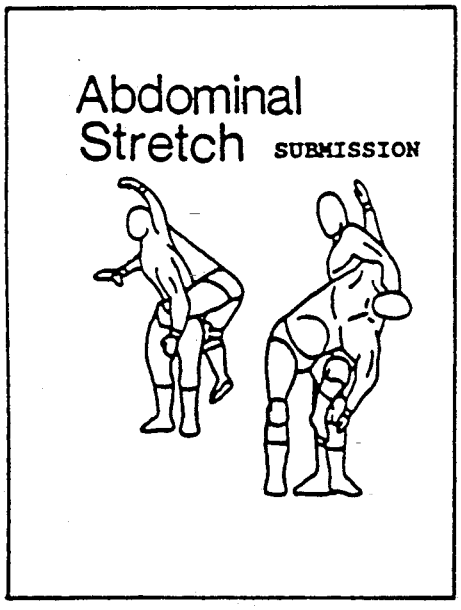
Figure 5D:
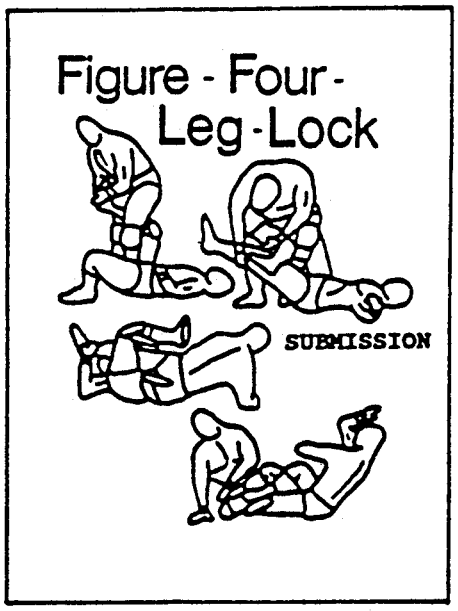
Figure 5E:
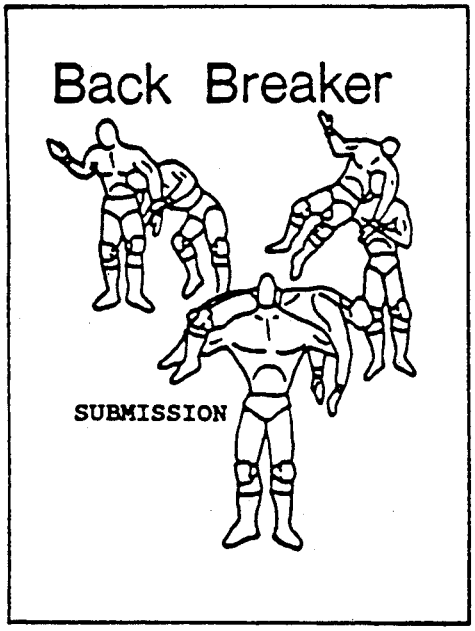
Figure 5F:
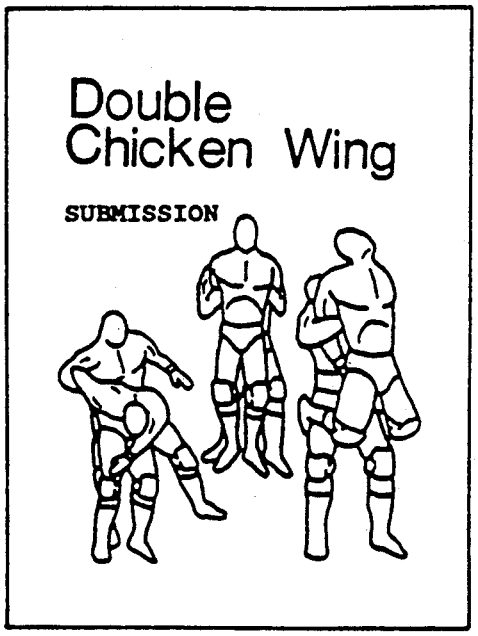
Figure 5G:
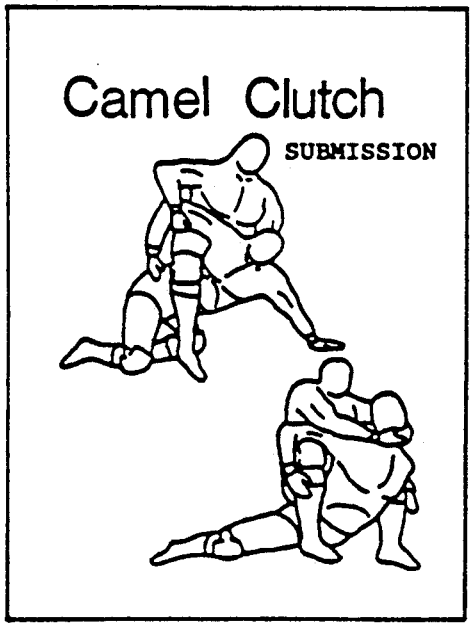
Figure 5H:
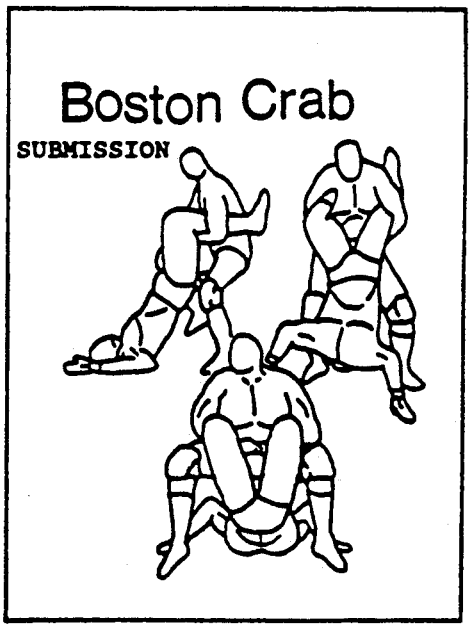
Figure 5I:
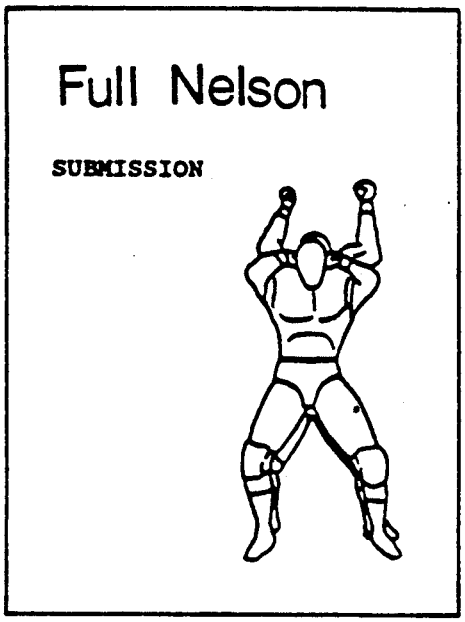
Figure 5J:
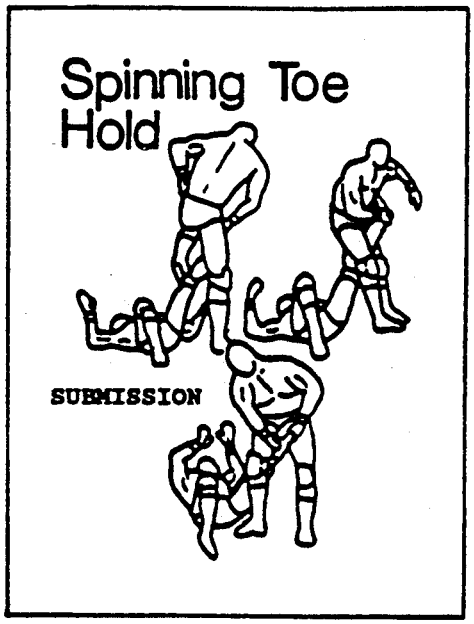
Figure 5K:
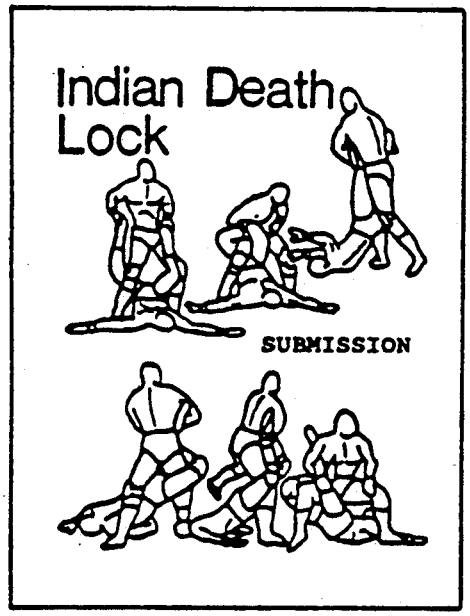

The present invention includes a plurality of images, each representing a type of wrestling maneuver which simulates maneuvers which are performed in the sport of wrestling.

A first portion of images represent thirty-three wrestling "action" maneuvers such as those frequently used by wrestlers. A second portion of images represent eleven "submission" maneuvers which are the types of maneuvers used in an actual sporting event to cause one competitor to submit, or to be pinned, and for said competitor to lose the wrestling match A third portion of images represent four "escape" maneuvers whereby the competitor may escape from and counter the maneuver being used by the other competitor. A fourth portion of images represent four "reverse" maneuvers whereby the positions of the competitors is completely reversed (i.e. countered). The competitor against whom the "reverse" image is applied is subjected to the maneuver which had been applied to the competitor who employed the "reverse" maneuver. A fifth portion of images represent two "substitute" maneuvers. The competitor having this image may designate the image as representing any image of portions first through fourth. In this respect, the "substitute" maneuver is a "wild" card which can represent any desired image as needed to meet the situation encountered during the playing of the game and is so marked.

It is preferred that fifty-four images 10 be provided. The first portion includes thirty-three images, the second portion includes eleven images, the third portion includes four images, the fourth portion includes four images and the fifth portion includes two images.

The first portion of thirty-three images are further subdivided into three groups, each of which include eleven images. The first group is assigned the numerical indicia "1", the second group is assigned the numerical indicia "2" and the third group is assigned the numerical indicia "3". In an alternate embodiment, the third group is assigned the numerical indicia "D" instead of indicia "3". The significance of these indicia will be described later.

Referring now to FIGS. 1A-1K, the "action" maneuvers with the numerical indicia "1" include respectively, the maneuvers of "Hip Toss", "Fireman's Carry", "Snap Mare", "Flying Drop Kick", "Monkey Flip", "Trap Toe Hold", "Irish Whip", "Double Wrist Lock", "Single Arm Drag with Arm Bar", "Single Arm Bar" and "Flying Head Scissor".

The following "action" maneuvers with the numerical indicia "2" are shown in FIGS. 2A-2K respectively. "Side Suplex", "Bear Hug", "Neck Breaker", "Shoulder Breaker", "Inverted Knee Drop", "Short Clothesline", "Back Drop", "Belly to Belly Suplex", "Scoop Slam", "Atomic Knee Drop", and "Head Butt".

FIGS. 3A-3K show the "action" maneuvers with the numerical indicia "3" respectively as "Superplex", "Power Body Slam", "Airplane Spin", "Power Clothesline", "Brain Buster", "Gut Wrench Suplex", "Inverted Back Breaker", "Pile Driver", "High Cross Body Block", "Spine Buster", and "Double Under Hook".

FIGS. 4A-4K show action maneuvers with the indicia "D". These represent double team images used in tag team play as will be described later.

The figures represent typical "action" maneuvers and are not intended to be an exhaustive listing. Other maneuvers known to persons skilled in the art have not been included due to the need to limit the maneuvers to thirty-three maneuvers within the context of the present invention. This limitation is also pertinent to the "submission" maneuvers which are described herein.

Referring now to FIGS. 5A-5K the "submission" maneuvers are shown respectively, "Cradle Suplex with Bridge", "Sleeper Hold", "Abdominal Stretch", "Figure Four Leg Lock", "Back Breaker", "Double Chicken Wing", "Camel Clutch", "Boston Crab", "Full Nelson", "Spinning Toe Hold", and "Indian Death Lock". These may also be called "pin" maneuvers.

Figure 6:
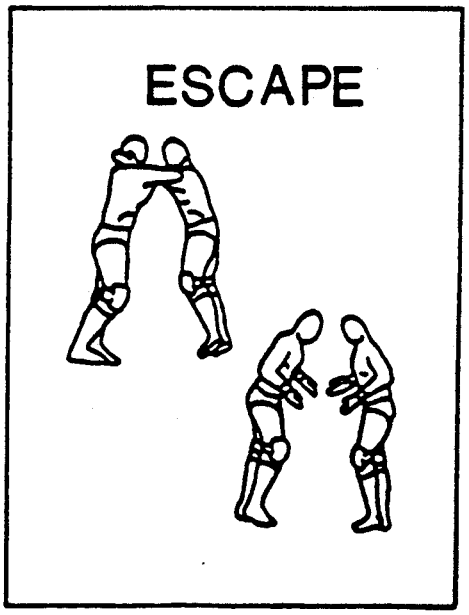
FIG. 6 illustrates the image of the wrestling "escape" maneuver displayed.

The third portion of images, FIG. 6, represent the "escape" maneuver.

Figure 7:
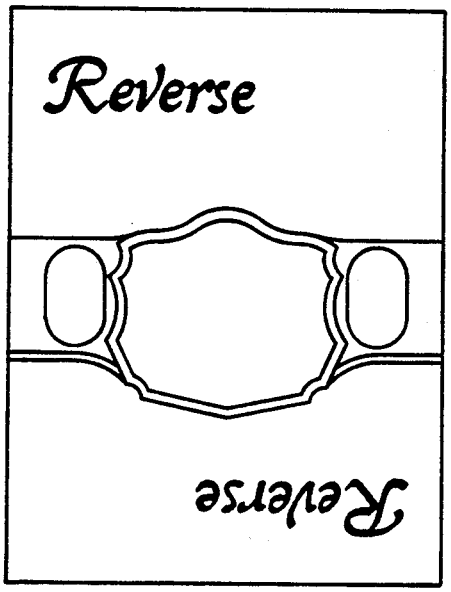
FIG. 7 illustrates the image of the wrestling "reverse" maneuver displayed.

The image representing the "reverse" maneuver constituting the fourth portion is shown in FIG. 7.

Figure 8:
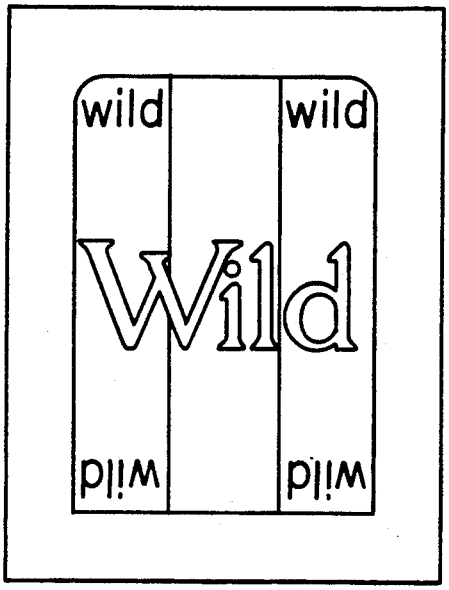
FIG. 8 illustrates the image of the wrestling "substitute" maneuver displayed.

The "substitute" maneuver constituting the fifth portion is shown as the image in FIG. 8 and is also known as a "wild" image.

In order to further differentiate between the portions and to facilitate rapid recognition of the portions, an indicator means has also been provided for the images. Thus, portion one with indicia "1", "2" and "3" is white and with indicia "D" is yellow; portion 2 is red, portions 3 and 4 are blue and portion 5 is red, yellow and blue. Other color designations may be made as desired and indicator means other than color may be used.

Figure 9A:
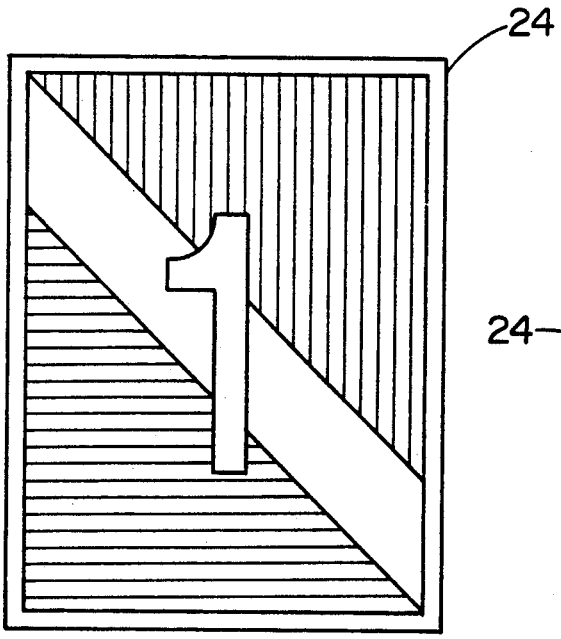
FIGS. 9A-9B illustrate the images representing the numbers of the team partners.
Figure 9B:
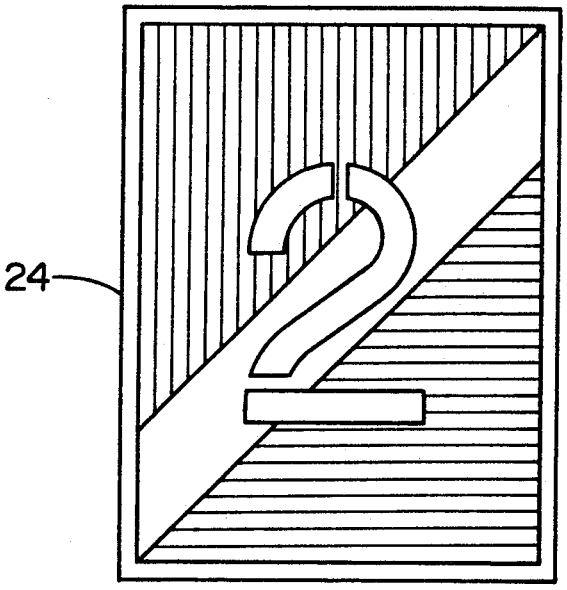

In addition, images representing members of the team (partners) are shown in FIGS. 9A-9B. These will be described in more detail.

Figure 11:
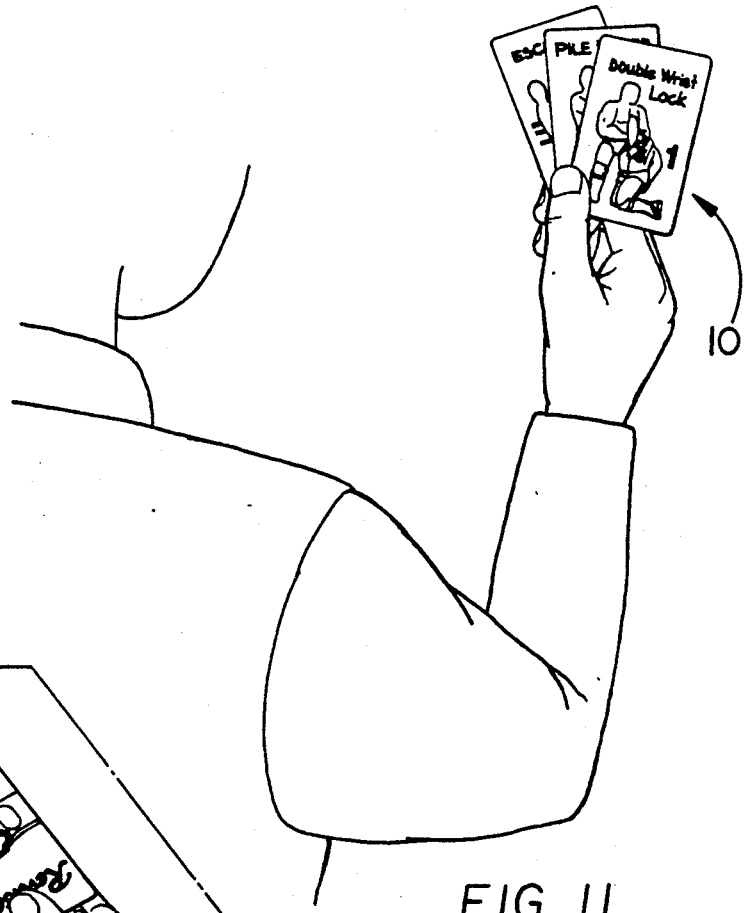
FIG. 11 is a perspective view of the cards in a typical use application.
Figure 10:
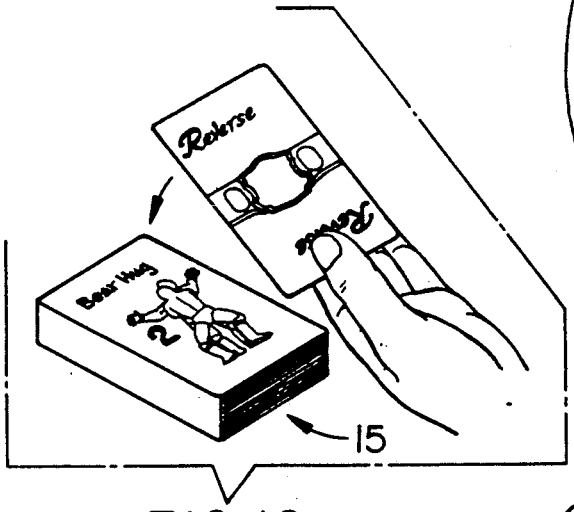
FIG. 10 is a perspective view of a plurality of playing cards.

Preferably, the images may be displayed on a plurality if playing cards 15 (FIG. 10). Each card has a respective image thereon. Each card has a front face and a back face. The front face of each card has the respective image thereon (FIG. 11). If desired, the cards may be fabricated from paper or plastic as is well known to those skilled in the art.

Figure 12:
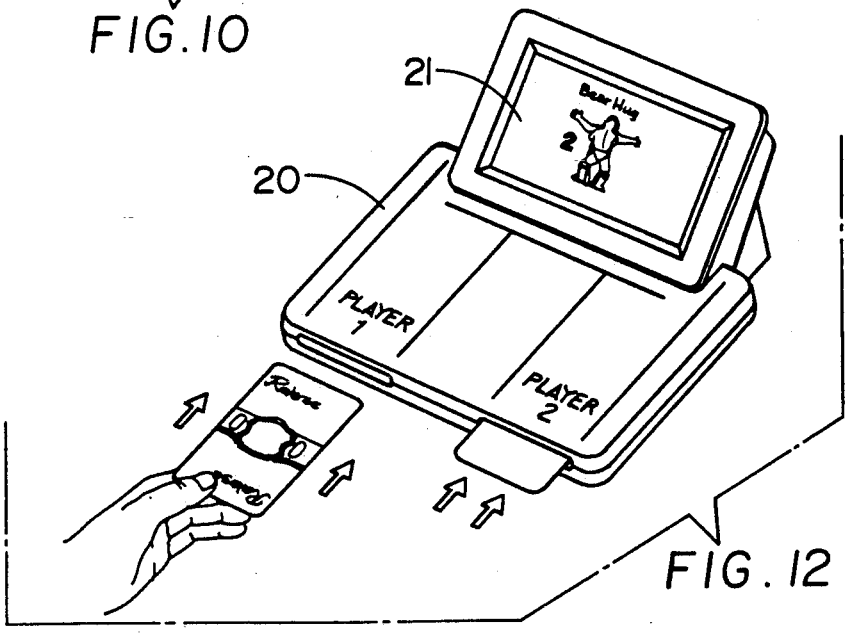
FIG. 12 is a perspective view of a video display of the images.

In another preferred embodiment (FIG. 12) means are provided for displaying the images on any suitable type of reading device 20 such as an optical or magnetic reader, well known to those skilled in the art. The reading device 20 may be integrated for use with a computer or other suitable device which is capable of interpreting and translating the image. The images on a card 22 are read by the reading device 20 and communicated to the computer which then displays the image on the video screen 21. The reading device 20 may be provided as a separate element.

Having described the apparatus of the present invention, the method of playing the game is now described. For illustrative purposes, the method as follows is described using playing cards but the method is also applicable to use with a video display.

The order in which the competitors (players) take turns is determined. The first competitor and the second competitor are thereby defined. This may be done by any suitable manner such as agreement between the competitors or flipping a coin. Each competitor randomly draws, in turn, a first plurality of images or playing cards. This plurality must be at least three images but may be any desired odd number of images. Each competitor has an equal number of images.

Next, the first competitor draws an additional image. The first competitor evaluates the images which have been drawn to determine whether a predetermined sequence of images is available. This sequence may consist of one of two alternatives. A first alternative includes three "action" images all having the same indicia thereon. That is, all three "action" images have a "1" indicia thereon, all three "action" images have a "2" indicia thereon, or all three "action" images have a "3" indicia thereon. The second alternative is that the three "action" images having indicia "1", "2", and "3" respectively thereon. In addition to the sequence of "action" images, the predetermined sequence includes one "submission" image. The "substitute" image may be used in place of any of the action images or of the submission image. If this predetermined sequence of images is available, the first competitor may elect to display the predetermined sequence of one "submission" image plus the three "action" images. The first competitor must say "submission" after displaying the predetermined sequence. The first competitor also may elect not to display the sequence for reasons which will be described and may "pass" any display. Also, if the first competitor does not have the predetermined sequence available, the first competitor "passes" any display of images. In this situation, the first competitor indicates that the second competitor should "go"—that is, draw a card or image.

Following the turn of the first competitor, the second competition draws an additional image. If the first competitor has displayed the predetermined sequence of images for "submission", the second competitor must display a counter image, if available, to avoid being assigned a penalty designator. The counter image may be an "escape", a "reverse" or a "substitute" image. If an "escape" image is used, the second competitor may use only the "escape" image to avoid being assessed a penalty designator. Alternately, if the second competitor has the available images, the second competitor may then display the predetermined sequence and say "submission" so that the first competitor must display a counter image. If the second competitor displays a "reverse" image, the first competitor is thereby required to display a counter image or be assigned a penalty designator. If a competitor displays a "substitute" (or wild) image, said competitor must state whether the "substitute" image is being used as an "escape" image or a "reverse" image. The sequential drawing and displaying of images continues between the competitors with the second competitor proceeding as described above and then the first competitor proceeding until a submission sequence is displayed by the first or the second competitor.

Figure 15C:
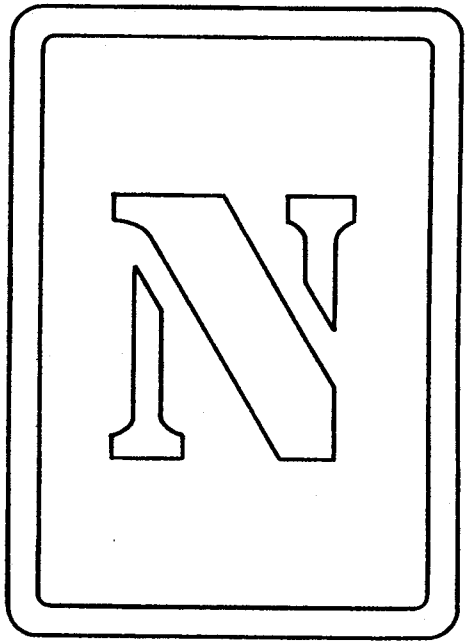
FIG. 15A-15C are plan views of a plurality of designators.
Figure 15B:
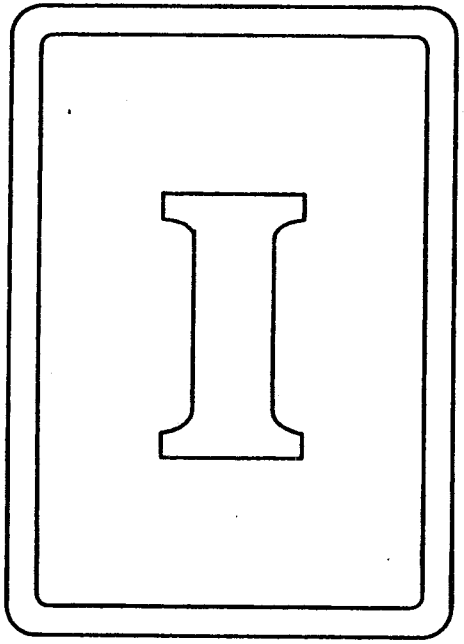
Figure 15A:
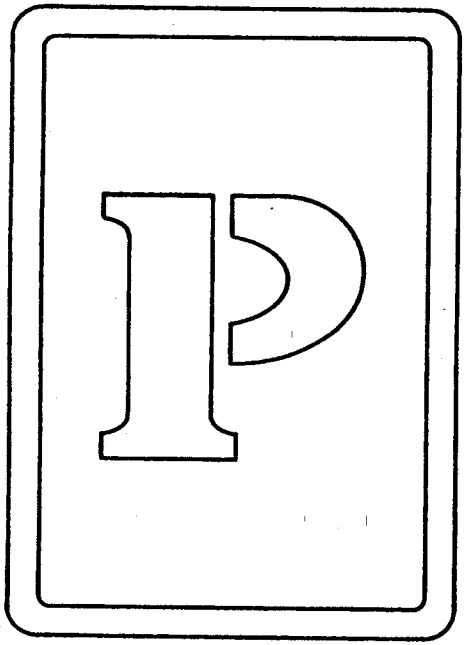

If the first competitor does not have available a counter image, the first competitor is assigned a penalty designator which is part of a sequence of penalty designators. A preferred sequence of penalty designators is "P", "I" and "N" FIG. 15A–15C although other designators may be used. When a competitor has been unable to counter a submission sequence, and has accumulated the PIN designators, that competitor is determined to be the loser.

When a competitor is unable to counter a submission sequence, said competitor is not only assigned the penalty designator but said competitor must also discard (or ditch) all but three of the images available to said competitor.

Each competitor must draw an image before any of the following: initiating a submission sequence, displaying a counter image, ditching images and telling the competitor to "go".

The images which are ditched are set aside. When the game has progressed until all but one image have been set aside, all of the set aside images are randomly mixed or shuffled and are combined for continuation of game.

The indicator means on the images, such as colors, greatly facilitate recognition by the competitors of the different types of images. For example, the blue color on the "reverse" and "escape" images enable the player to know instantaneously that this essential image is available so that the player can better plan the strategy of the game.

A major strategy of the game is to plan when to display the submission sequence. One approach is for the competitor to have available at least one counter image so that there is a back-up in the event the opposing player displays a "reverse" image. Another approach is to have another submission sequence available as back-up. A more aggressive player may have no back-up. Also, as the competitors accumulate penalty designators, the style of play may become more conservative. These variations provide excitement, interest and variety to the game.

Figure 14:
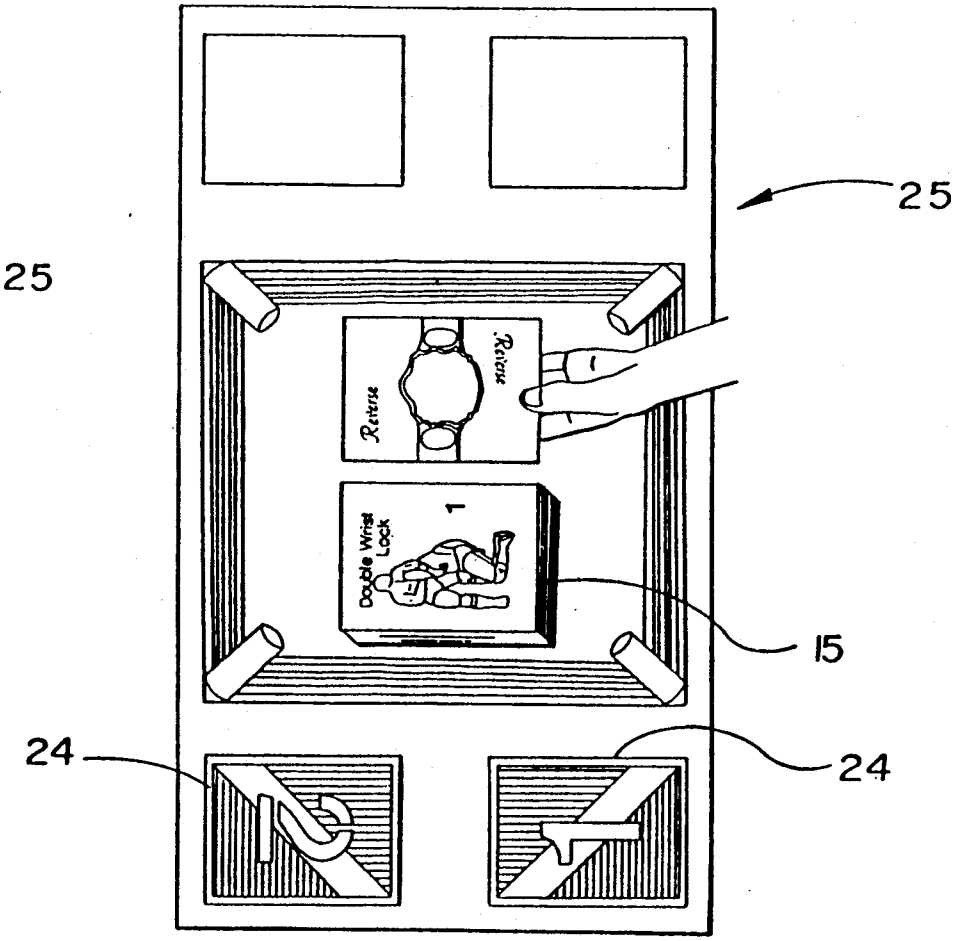
FIG. 14 is a perspective view of a typical use of the game showing the wrestling ring, the images representing the maneuvers and the images representing the numbers of the team partners.
Figure 13:
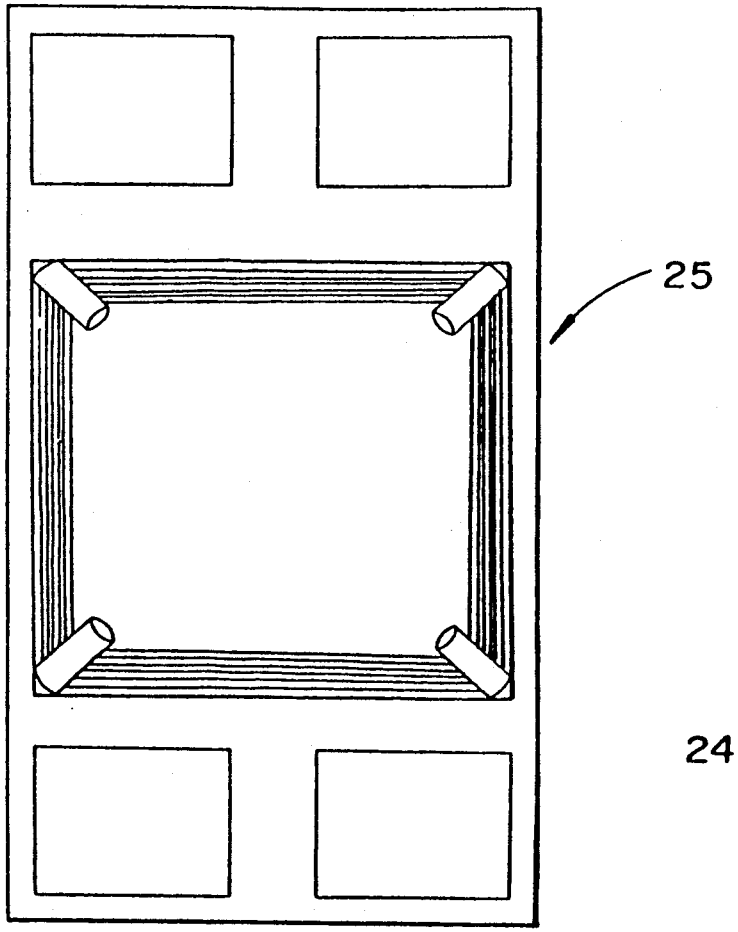
FIG. 13 is a plan view of a board simulating a wrestling ring.

In an alternate embodiment, the game simulates a competitive wrestling tag team match. The four competitors are arranged into a first team having two players (partners) and a second opposing team having two players (partners). The method of playing the game is substantially the same as previously described for two competitors with several differences. One difference is the use of an action maneuver images having a "D" indicia (FIGS. 4A–4K) which depict wrestling maneuvers in which two members of the same team are engaging one member of the opposing team. These images are used in place of the action maneuvers having a "3" indicia. A further difference is the use of images representing members or partners of each team 24. As shown in FIGS. 9A–9B, there are numerals 1 and 2 although other types of images may be used. A total of four of these images are provided, one for each competitor. The purpose of these images is to identify a first and a second member of each team. Each team must choose the player to represent the respective team and the image for the representative player (or challenger) is placed on the playing surface such that all competitors are aware of which players are challenging each other at any time during the course of the game. In order to further enhance the interest in the game and to more nearly simulate wrestling, a board 25 showing a wrestling ring is provided (FIG. 13). The images representing the wrestling maneuvers 10 and the images representing the challenging players 24 may be displayed on board 25 (FIG. 14). The use of the images representing the team members 24 and of the board 25 is optional and not essential to playing of the game. A still further difference is the ability of a team member to "tag" the partner to switch between challengers of the same team. A tag can be accomplished by one partner saying "tag" or a similar word or phrase to the team partner. A tag is permitted only when the opposing team has not displayed a submission sequence. A tag is permitted to enable a team to display a submission sequence. For example, team partner No. I may display wrestling maneuver images having indicia "1" and "2". A tag is made. Team partner No. 2 may display the "D" image. A tag is made. Team partner No. 1 may display the submission image. In order to better utilize the "tag" feature, the partners of each team are permitted to compare images and talk to each other to determine the strategy to be employed. These comparisons and discussions may be held at any time during the course of the game. However, it is not permitted for the team partners to exchange images at any time.

In summary, the tag team embodiment is played as follows. There are four players in a game, two per team. To start the game, the dealer can deal out any odd number of playing images (at least three). The dealing team must draw second. Before an image is drawn from the deck, each team must choose a challenger; the chosen challenger must then put his/her number in a box in the wrestling ring. Each player of a tag team is identified as player number 1 or player number 2. Only players having a player number in the ring can draw images from the deck, and the images must be drawn before initiating a pinning combination, means of escape, the ditching of cards, and telling opponent to "go". A tag can only be given when there is no pinning combination displayed. Tagging is also permitted to complete a pinning combination. A switch of tag team partners is done when a partner says the word "tag" to the other partner. Tag team partners can see each other's cards and talk to each other about a strategy to defeat the other team. Each player of a team cannot, at any time, exchange images. Each player has the option to either proceed with displaying, to the opponent, the pinning combination or means of escape, or telling the opponent to "go". Each player must say "submission" before and after displaying the pinning combination. Each player can display an "escape", "reverse", or "substitute" (wild) image to counter a submission sequence. If a player in the ring does not have an "escape", "reverse" or "wild" image to counter a submission sequence, said player must "ditch" all but three images and place the "ditched" images on top of the deck and the team receives a P, I, or N as a penalty designator. If a player has three or less images available, the player cannot "ditch" any images. However, the team still receives a penalty designator.

An important feature of the tag team is the ability of the partners of each team to compare the available images at any time during the course of the game and to discuss strategy. In this manner, the partners know what images are available to the team and decisions can be made whether to draw additional images or whether to display a sequence of images. Under the tag feature, it is also possible to devise a strategy of tagging the partner to assist in displaying a desired sequence of images. This feature provides increased interest and excitement to a competitive game.

Obviously, many modifications may be made without departing from the basic spirit of the present invention. Accordingly, it will be appreciated by those skilled in the art that, within the scope of the appended claims, the invention may be practiced other than has been specifically described herein.

What is claimed is:

1. A method of playing a competitive game for four competitors that simulates a competitive wrestling tag team match, wherein one team has two partners and another opposing team has two partners, said game having a plurality of images representing wrestling maneuvers, the method comprising the steps of: identifying a member of the one team and a member of the other opposing team to challenge one another; each identified member drawing at least three images; if desired, the identified member tagging the partner thereof to interchange the identified member of the respective team between the partners of the respective team; the partners of each team sharing information on the images drawn by the respective partners; drawing and displaying images by the identified members of the opposing teams in alternating sequence, the identified member of the one team displaying the images in a predetermined sequence, the identified member of the other team displaying a counter image, if available, and if said counter image is unavailable, determining a winning team to be the team displaying the predetermined sequence of images.

2. The method of claim 1, wherein each identified member draws an equal number of images.

3. The method of claim 1, wherein the predetermined sequence of images is three images.

4. The method of claim 3, wherein the three images are identical images.

5. The method of claim 1, wherein the partners of the respective teams visually share information on images continuously throughout the progress of the game, the exchange of images between partners being prevented.

6. A method of playing a competitive game for two or more competitors that simulates a competitive wrestling match, said game having a plurality of images including at least a first portion of images representing wrestling maneuvers, a second portion of images representing countering maneuvers to the first portion of images and a third portion of images representing completion of a wrestling match, the method comprising the steps of: distributing a predetermined number of images to each competitor; drawing and displaying images by the competitors in a sequential manner; displaying a predetermined sequence of wrestling maneuver images and at least one completion image by one of the competitors; displaying the counter maneuver image, if available, by the other competitor; continuing drawing and displaying images by the respective competitors, and determining a loser to be the other competitor not having available a counter maneuver image to display following display by the one competitor of the predetermined sequence of wrestling maneuver images and the at least one completion image.

7. The method of claim 6, wherein the first portion of wrestling maneuvers are representations of individual wrestlers engaging in said maneuvers.

8. The method of claim 6, wherein the predetermined sequence of images is three images.

9. The method of claim 8, wherein the three images are identical images.

10. The method of claim 8, wherein at least three completion images are displayed.

* * * * *